US005227691A

United States Patent [19]

Murai et al.

[11] Patent Number: 5,227,691

[45] Date of Patent: Jul. 13, 1993

[54] FLAT TUBE DISPLAY APPARATUS

[75] Inventors: Ryuichi Murai, Katano; Kinzo Nonomura, Ikoma; Satoshi Kitao, Kyoto; Jumpei Hashiguchi, Suita; Kiyoshi Hamada, Sakai; Masayuki Takahashi, Katano, all of Japan

[73] Assignee: Matsushita Electric Industrial Co., Ltd., Osaka, Japan

[21] Appl. No.: 823,612

[22] Filed: Jan. 17, 1992

Related U.S. Application Data

[63] Continuation of Ser. No. 525,714, May 21, 1990, abandoned.

[30] Foreign Application Priority Data

May 24, 1989 [JP] Japan ..... 1-130867
May 24, 1989 [JP] Japan ..... 1-130868

[51] Int. Cl.[5] ..... H01J 29/70; H01J 1/62

[52] U.S. Cl. ..... 313/422; 313/431; 313/497

[58] Field of Search ..... 313/422, 497, 431; 315/3.5

[56] References Cited

U.S. PATENT DOCUMENTS

| | | | |
|---|---|---|---|
| 3,627,550 | 12/1971 | Monneraye . | |
| 3,705,327 | 12/1972 | Scott | 315/3.5 |
| 3,787,747 | 1/1974 | Scott | 315/3.5 |
| 4,099,085 | 7/1978 | Endriz et al. | 313/422 |
| 4,158,157 | 6/1979 | Schwartz | 313/422 |
| 4,166,233 | 8/1979 | Stanley | 313/422 |
| 4,167,690 | 9/1979 | Garge | 313/422 |
| 4,523,225 | 6/1985 | Masuda et al. | 313/422 |
| 4,780,395 | 10/1988 | Saito et al. . | |

FOREIGN PATENT DOCUMENTS

| | | |
|---|---|---|
| 0070060 | 1/1983 | European Pat. Off. . |
| 0281191 | 9/1988 | European Pat. Off. . |
| 55-16392 | 2/1980 | Japan . |
| 63-226863 | 9/1988 | Japan . |
| 63-228552 | 9/1988 | Japan . |
| 2-250232 | 10/1990 | Japan . |
| 8505491 | 12/1985 | World Int. Prop. O. . |

OTHER PUBLICATIONS

Jachym, et al., Journal of Physics D. Applied Physics, "The Use of Three-Component Polymeric Composites in Preparing a Channel Electron Multipler", vol. 16, No. 10, pp. 2023-2032, Oct., 1983.

*Primary Examiner*—Donald J. Yusko
*Assistant Examiner*—Brian Zimmerman
*Attorney, Agent, or Firm*—Stevens, Davis, Miller & Mosher

[57] ABSTRACT

A flat tube display apparatus wherein a row of many electron beam generators is arranged transversely in a thin flat vacuum tube body to generate a number of beams in parallel with each other which travel in parallel with an image screen and to deflect the beams toward the image screen at a predetermined position. The beams are guided without being widely diverged due to the provision of a number of side walls arranged in parallel with each other to confine beams and due to the provision of alternately strong and weak magnetic fields along the side walls. Image brightness can be further increased by a frit-glass-laminated structure of a multiplier or microchannel.

4 Claims, 9 Drawing Sheets

FLAT TUBE DISPLAY APPARATUS

This application is a continuation of application Ser. No. 07/525,714 filed May 21, 1990 now abandoned.

BACKGROUND OF THE INVENTION

The present invention relates to a display apparatus, and particularly to a flat tube type display apparatus comprising a flat display tube in which electron beams run in parallel with a screen surface and are deflected before they are addressed and landed.

DESCRIPTION OF THE PRIOR ART

Recently, the various kinds of flat type display apparatus such as liquid crystal displays (LCD), electroluminescence displays (EL), light emitting diode displays (LED) and the like have been prosperously developed and some of them have been commercially available. However, the above-mentioned kinds of flat type display apparatus are inferior to CRT type display apparatus in view of brightness, resolution, quality in full-color display, and the like.

In order to solve the above-mentioned problems, there have been proposed various flat tube type display apparatus using an electron multiplier, one of which is disclosed in Japanese Patent Unexamined Publication No. 63-228552.

The conventional flat tube display device as disclosed in the Japanese Patent Unexamined Publication No. 63-228552 will be hereinbelow detailed, referring to FIGS. 13 to 14*b*.

First referring to FIG. 13 which is a transverse sectional view illustrating the above-mentioned flat tube display apparatus, an electron beam emitted from an electron gun at a low speed (about 500 eV) with a low density (about 1 μA) is line-deflected by a deflector 133. A potential of 400V is applied between an electrode on the rear side surface 131 of a divider 135 and a face electrode 136 laid at the surface of a vacuum tube body opposing the rear side surface 135. The above-mentioned line-deflected electron beam is led straightforward by means of an electrostatic periodic lens to a position in the vicinity of a trough-like electrode 137 at 0 voltage potential which is located at the upper end part of the vacuum tube body.

The above-mentioned electrostatic periodic lens consists of two groups of electrodes. The first group is composed of electrodes laid on the rear side surface 135 of the divider 131 and an electrode laid on the surface of the vacuum tube body facing the rear side surface, and the second group is composed of a plurality of pairs of elongated electrodes laid in the line-deflecting direction, the elongated electrodes in each pair are opposed to each other. With this arrangement in which the plurality of pairs of the elongated electrodes are arranged at predetermined intervals so as to confine therebetween the electron beam emitted from the electron gun and led by the first group of electrodes, the electron beam is applied periodically with high and low voltages. That is, the second group of electrodes in pairs servers as the above-mentioned electrostaitc periodic lens by which the electrode beams are refocussed continuously so as to be held in a predetermined plane.

A reversing lens is formed by a potential difference between the trough electrode 137 and the face electrode 136, by which the electron beam having come straightforward to the upper end of the vacuum tube body is curved so as to take a substantially circular travel. Accordingly, the electron beam enters into the front side space of the vacuum tube body. Then the electron beam is deflected by changing the potential applied by a plurality of separate electrodes 138 which are laterally elongated and longitudinally spaced from each other and which are arranged on the front side of the divider 131. That is, the electron beam is deflected toward an electron multiplier 134 so as to perform frame scanning. Then, the electron beam lands on the multiplier and enters into a predetermined opened hole therein. The multiplier 134 is composed of a plurality of dynode layers with a typical potential difference between the first and final layers of about 3 KV. This multiplier 134 may be also called as a microchannel plate. The electron beams landing in the predetermined opened hole is amplified by about 500 to 700 times, and is then led onto a predetermined luminescent element 139 by means of one of color selecting means 140 arranged at the final stage of the multiplier 134 so that the desired luminescent element 139 emits light.

Explanation will be made hereinbelow of the multiplier or the microchannel plate 134. FIG. 14*a* is an enlarged cross-sectional view illustrating the microchannel plate 134.

Each dynode layer is made of a metal plate having a thickness of 0.15 mm and formed therein with several opened holes having a substantially circular shape. The cross-sectional shape of each opened hole is in an asymmetrical shape having a large diameter hole part with a bore diameter of 0.42 mm and a small hole part with a bore diameter of 0.3 mm. A shadow mask for a CRT can be used as this plate. The inner wall surface of the opened hole is coated thereon with a material 134 having a large ratio of secondary electron emission, such as magnesium oxide or the like. A plurality of dynode electrodes each composed of a pair of such plates having several opened holes formed therein and faced to each other are stacked one upon another with resistive or insulation spacers 146 which are, for example, small glass spheres so-called as ballotines intervening therebetween, having a diameter of 0.15 mm, thereby forming the microchannel plate.

As proposed in Phillips Journal of Research Vol. 141, a voltage value applied between the dynode layers 144, is about 300V, and the number of the dynode layers is seven. In this case the potential difference between the first and final stages becomes about 2 KV.

The electron beam having entered into a desired opened hole is amplified by about 500 to 700 times with a magnification of 3 to 3.3 per stage, and is led to a desired luminescent element by means of one of color selecting means arranged at the final stage of the multichannel plate.

However, the above-mentioned conventional flat tube display apparatus is disadvantageous since it is difficult solve a problem of a proof voltage, and to obtain an image having a high purity and a high quality.

In order to obtain a sufficient brightness for the image, there have been proposed raising of current density of an electron beam emitted from an electronic gun 132 or increasing of energy of an electron beam, and increasing of a current amplifying rate of the microchannel plate.

In order to increase the current density of an electron beam from the electron gun 132, the beam radius of the electron beam increases, resulting in a large aberration (spherical aberration) during passing of the electron beam through the reversing lens composed of the trough electrode 137 and the flat surface electrode 135, and accordingly, the shape of the electron beam deforms largely. Further, the deformation of the electron beam varies in dependence upon a position on the reversing lens at which the electron beam passes through the reversing lens, causing comma aberration. Thus deformed electron beam impinges upon opened holes other than a desired opened hole, causing lowering of the contrast of an image, cross-talk and the like. Further, if the energy of the electron beam would be increased, it would offer such a disadvantage that the voltages applied to the electrostatic deflector 133 and the reversing lens become higher. Thus, it is practically difficult to increase the current density and energy of the electron beam emitted from the electron gun 132.

In order to solve the above-mentioned disadvantages, Japanese Patent Unexamined Publication No. 63-226863 proposes a flat tube display apparatus in which the reversing lens is eliminated while several semiconductor electrodes are arranged on a line widthwise crossing the flat tube body, for emitting several parallel electron beams. Since no provision of the reversing lens, the above-mentioned spherical and comma aberrations can be eliminated, and further due to the use of the semiconductor electrodes which can emit several parallel electron beams simultaneously, a relatively bright image can be obtained. Further, since the electron beam is not turned reversely in the flat tube, it is possible to reduce the thickness of the flat tube.

Further, U.S. Pat. No. 3,787,747 discloses a periodic magnetically focused beam tube adapted to be used in a display apparatus in which a sheet-like shape electron beam is converted into light. Further, periodical magnetic fields are applied from the outside of the beam tube, and accordingly, the influence of the magnetic fields to the electron beam is low due to the long distance between the magnetic field source and the electron beam, and no reinforcing measures for allowing the vacuum tube to withstand against the atmospheric pressure is provided. Accordingly, difficulty is encountered in providing a large size beam tube of such a kind.

However, even with this flat tube display apparatus, there is offered such a disadvantage that each of the electron beams emitted from the semiconductor electrodes cannot be surely led to a predetermined position at which the electron beam is deflected for addressing and landing, over a relative large travel distance since the electron beams is likely to diverge during its travel, causing cross-talk.

Further no fillers are used in the above-mentioned flat-tube display apparatus, and accordingly this flat-tube display apparatus is difficult to withstand the external atmospheric pressure. Therefore, it is extremely difficult to produce a large size flat tube display apparatus.

As another method of improving luminance, it is necessary to increase the current amplifying ratio of the microchannel plate. In order to increase the current amplifying ratio of the microchannel plate 134, it is necessary to increase the number of microchannel plate 134 layers, or to increase the potential difference within one layer, or to augment the multiplication ratio of a secondary electron on the inner wall of the opened hole. An increased number of microchannel plate 134 layers causes an increase in the apparatus weight as well as in costs, making production much more difficult. That is, it is obvious that difficulties in production would increase with an increased number of layers, in an exponential function manner, if the opened holes arranged in dynodes are positionally aligned with each other through the entire microchannel plate with several layers.

Another measure for augmenting the current amplifying ratio of the microchannel plate 134 is to increase the potential difference applied among the layers. However, an increased potential difference would increase the field strength among the dynodes and thus cause the withstand voltage properties to deteriorate. The result is that a discharge is more likely to occur among the dynodes, or between the dynodes and spacers 146 during image being displayed. Thus the increase of the potential difference is limited.

Application of a substance having a high secondary electron emission ratio on the inner walls of the opened holes is sufficient in order to augment the current amplifying ratio of the microchannel plate by increasing the multiplication ratio of the secondary electrons on the inner walls of the opened holes. However, other than MgO currently in use, no substance exists which has a higher secondary electron emission ratio than MgO, is stable in a vacuum and is inexpensive.

Furthermore, in the conventional microchannel plate 134, there is a relationship between the size of an opened holes disposed on a thin metal plate and the hole shapes in cross section, i.e., the relationship between the size of large holes and that of small holes, and also there is an optimum value for a space between thin metal plates. The above mentioned relationship and the optimum value greatly affect the secondary electron emission ratio.

As shown in FIG. 14*b*, the secondary electron of an electron beam, which has impinged upon the first stage of a dynode, emanates according to the cosine rule from a metal side wall. A voltage applied between the metal side wall and the next metal side wall determines an electric field. A force is applied to the secondary electron by this electric field. The secondary electron then travels toward a high voltage side while substantially forming a circle. However, as has been explained, since the velocity vector of the secondary electron is dispersed, the secondary electron does not reach a dynode electrode in a second stage. A considerable number of electrons cannot arrive but at the insulation layer, thereby decreasing the current amplifying ratio.

Japanese Patent Unexamined Publication No. 55-16392 discloses a method of producing conventional microchannel plates. According to the production method, when ballotines are used as a spacer, there arises a disadvantage in that it is necessary to perform a thermal process several times in addition to the above-mentioned difficulty in alignment of the opened holes.

The microchannel plate hitherto described is of a dynode type, however there may be used secondary electron multipliers using glass in another method.

A material for a conventional electron multiplier using glass will be hereinbelow explained. In order to utilize glass as a material for the electron multiplier, it is desirable to utilize a stable material which has a high secondary electron emission ratio and suitable conductivity. Conventionally, such materials as cited below have been employed to maintain conductivity in glass:

(1) Material in which glass containing much PbO is reduced with hydrogen before a Pb conductive layer is formed on its surface.

(2) Material in which a conductive layer of a metal oxide or of an intermetallic compound is evaporated on commonly used glass.

(3) Material in which a transitional metallic oxide such as $Fe_2O_3$, $V_2O_3$, $WO_2$, is added to commonly used glass.

The above-cited conventionally employed materials have the following problems, respectively:

(1) The material is unstable even after a conductive layer is formed by reducing PbO because a conductive ratio will vary owing to the thermal treatment thereafter. Moreover, forming a stable conductive layer by a reduction process is difficult.

(2) It is difficult to deposit a uniform conductive layer on a glass surface since the glass surface may not be flat in many cases.

(3) It is difficult to obtain a desirably shaped secondary electron multiplier because glass properties, such as viscosity, alter once $Fe_2O_3$ or the like is added to glass.

SUMMARY OF THE INVENTION

It is an object of the present invention to overcome the above-described problems and to provide a flat tube display apparatus which has a high performance and is easily manufactured and modified.

More specifically, the object of this invention is to overcome the above-mentioned problems and to provide a flat tube display apparatus using a new method which permits a high image quality equal to that of a CRT and high luminance, and which is capable of being increased in size.

A thermal electron source is arranged on one side in a horizontal direction of a display screen. An electron beam emitted from the thermal electron source is guided by with a periodic magnetic lenses without being diverged so as to be led substantially in parallel with the display screen. The periodic magnetic lens is formed by screen printing of frit glass mixed with magnetic powder, and is obtained by calcining and magnetizing the screen. The electron beam guided by the periodic magnetic lenses is deflected on a fluorescent face side at a desired position, and is amplified by an electron beam amplifier by 10 to 100 times. The electron beam then allows a fluorescent substance to emit light. The electron beam amplifier is manufactured by calcining or sintering a compound containing, as main materials, glass and an oxide conductive substance.

The use of the periodic magnetic lenses as an electron beam guide eliminates problems with a withstand voltage, and thus allows the electron beam to be guided to occupy a desired position without diverging the electron beam. The components of the periodic magnetic lenses serve as not only electron beam guides but also pillars in the vacuum tube body. It is therefore possible to increase the strength of the vacuum tube body which can withstand the external atmospheric pressure and to provide a large-scale flat tube display apparatus.

Other features and advantages will become apparent from the following Description of the Preferred Embodiments when read with reference to the accompanying drawings.

DESCRIPTION OF THE PREFERRED EMBODIMENTS

Figure 1:
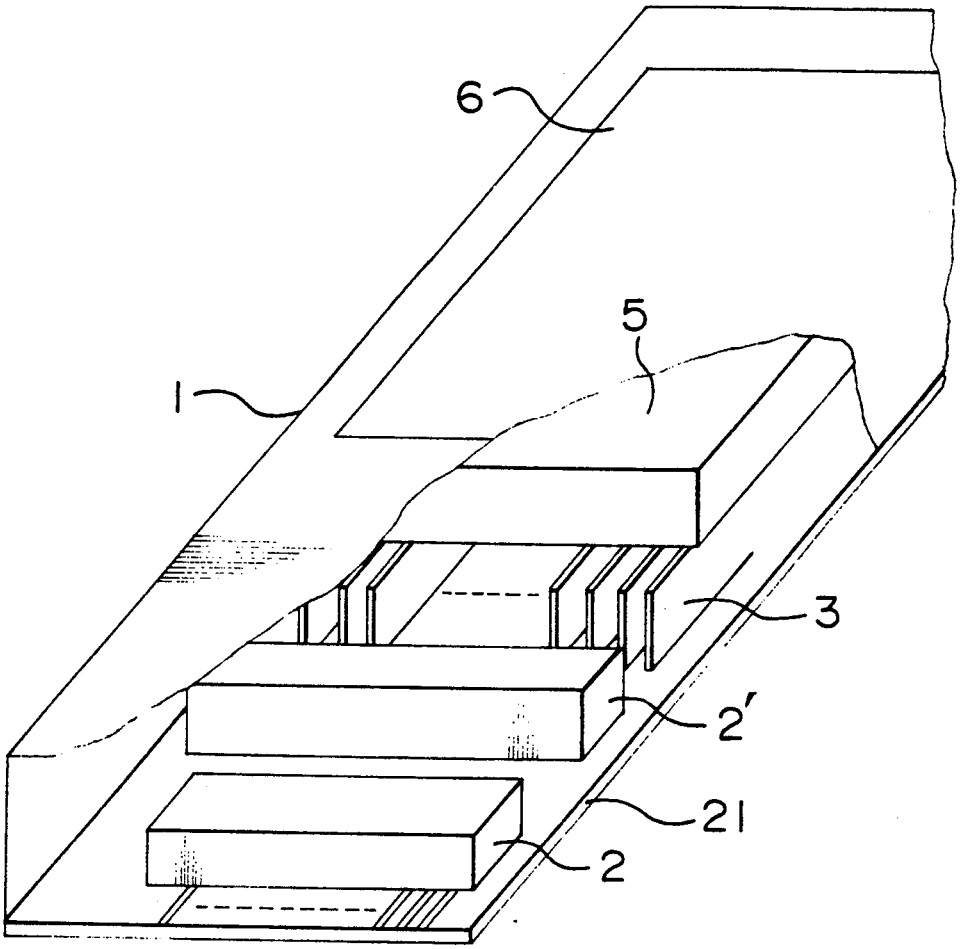
FIG. 1 is a perspective view showing a flat tube display apparatus according to an embodiment of the present invention.

The embodiments of the present invention will be hereinbelow explained with reference to the accompanying drawings. FIG. 1 shows the construction of the flat tube display apparatus according to the present invention.

Within a vacuum tube body 1 are contained an electron beam source utilizing thermal electron emission and an electron beam generating portion 2 including an electron lens system which accelerates and converges the thermal electrons emitted. Further, an electron beam guiding portion 3 for guiding an electron beams, which has been generated in the electron beam generating portion 2, so as to lead the electron beams to desired positions without diverging the electron beams, and an electron beam deflection system for deflecting the guided electron beams onto a face plate side are housed in the vacuum tube body 1. An electron beam amplifying and emitting portion 5 for amplifying the deflected electron beams and for allowing fluorescent substance to emit light at the final stage is further housed in the vacuum tube body 1. Moreover, the vacuum tube body 1 carries the face plate 6.

The electron beam generating portion 2, the electron beam inducing portion 3 and the electron beam amplifying and emitting portion 5 will be hereinafter detailed, in that order.

Figure 2:
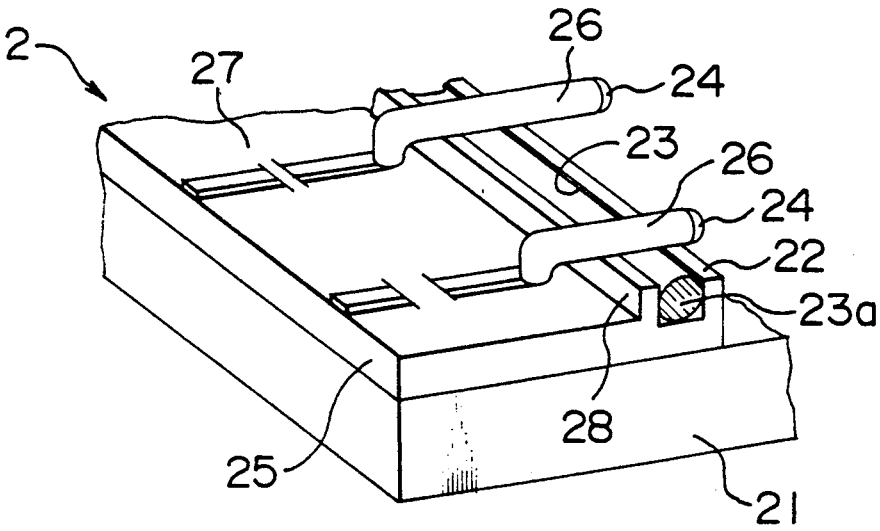
FIG. 2 is an enlarge perspective view showing an electron beam generating portion in the embodiment shown in FIG. 1.

FIG. 2 shows the electron beam generating portion 2. A thermally insulated layer 25 of a 2–100 μm thickness is laid transversely on the base of a glass plate 21 which, defines the vacuum tube body 1 of the flat tube display apparatus. One end part of the thermally insulated layer 25 is raised and a recess 23 is formed in a part of the raised portion. The recess 23 is in the shape of a circle having a diameter of about 20 μm or of a rectangle having dimensions of about 10 μm×20 μm. A tungsten wire 23*a* having a high melting point, is wired in the recess 23. An oxide cathode 24 is heated by applying a current to the tungsten wire 23*a*. The oxide cathode 24 is attached by electro-deposition or like method to the tip of a 10–30 μm diameter nickel wire 26. The 5 mm long nickel wire 26 is grounded through a resistor (not shown) and has the oxide cathode made of BaO, at one tip thereof. The other tip of the nickel wire 26, this tip acting as the secondary side of a voltage applying wire for modulation, is combined with a capacitive element or inductive element 27. The nickel wire 26 is coated with an insulating film made of, for example, aluminum, to prevent cross-talk. The electron beam generating portion 2, except for the nickel wire 26 having the oxide cathode, is formed by printing, depositing, or the like. Each electron beam is accelerated by a plurality of electrodes (not shown) in front of the electron beam generating portion, which is formed by printing, depositing, or the like, to 50–200 eV, and is focused into an electron beam with a small angle of divergence.

Figure 3:
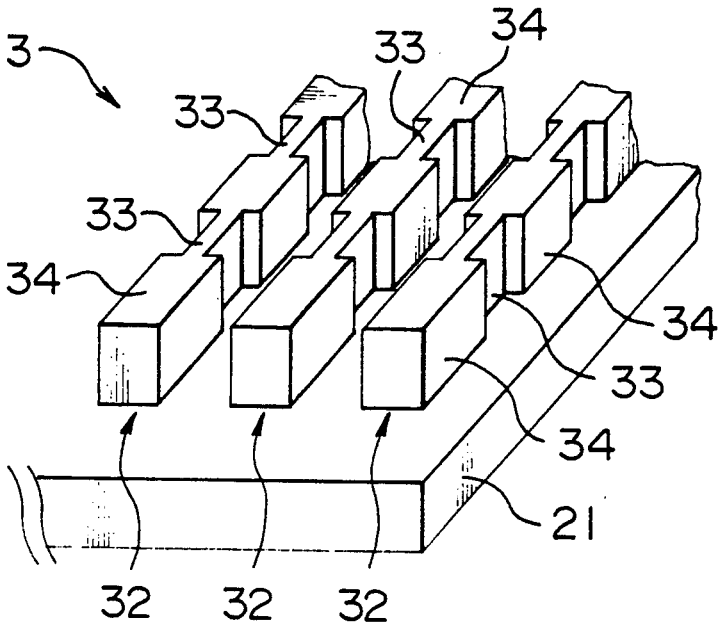
FIG. 3 is a perspective view illustrating an electron beam guide in the embodiment shown in FIG. 1.

FIG. 3 is a view of the electrode beam guiding portion 3 using an electric field. As shown in FIG. 3, a plurality of substantially rectangular parallelepiped-like side walls 32 are arranged on the glass substrate 21. The surface of side walls 32 are made of, for example, an aluminum conductive material. The side walls 32 having a 30–50 μm width and a 20–50 μm height are arranged at about 100 μm intervals. In the side walls 32, thin wall portions 33 and thick wall portions 34 are disposed at 1 to 10 mm intervals in the direction in which an electron beam travels. The thickness of the thin wall portion 33 is 10–20 μm thinner than that of the thick wall portion 34. With this arrangement, the electron beam is guided as if there were a group of positive and negative convergent lenses, to be led to any position without being diverged.

Figure 4:
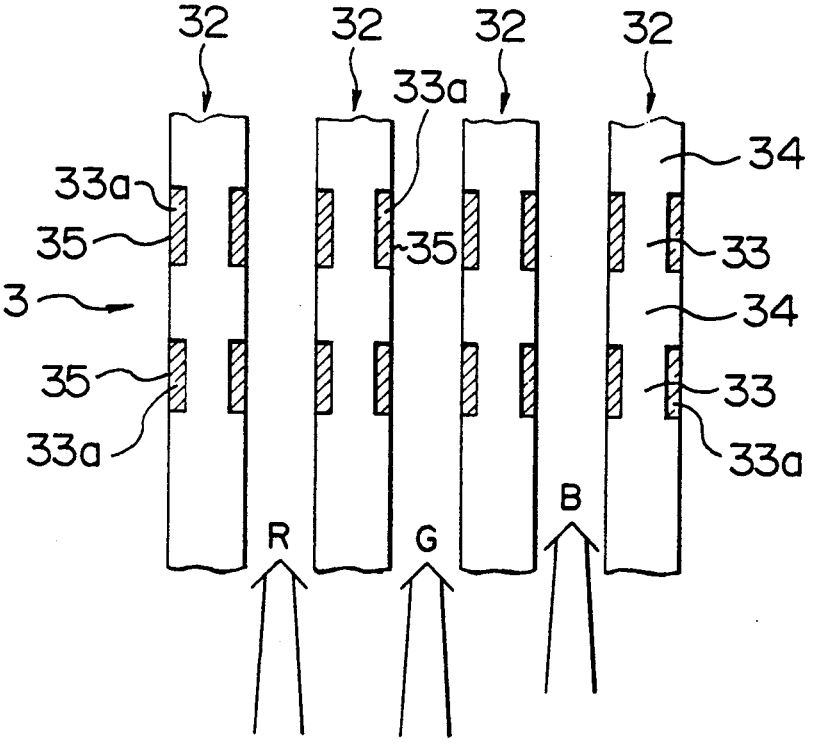
FIG. 4 is a plan view illustrating an modification to the electron beam guide shown in FIG. 3.
Figure 5:
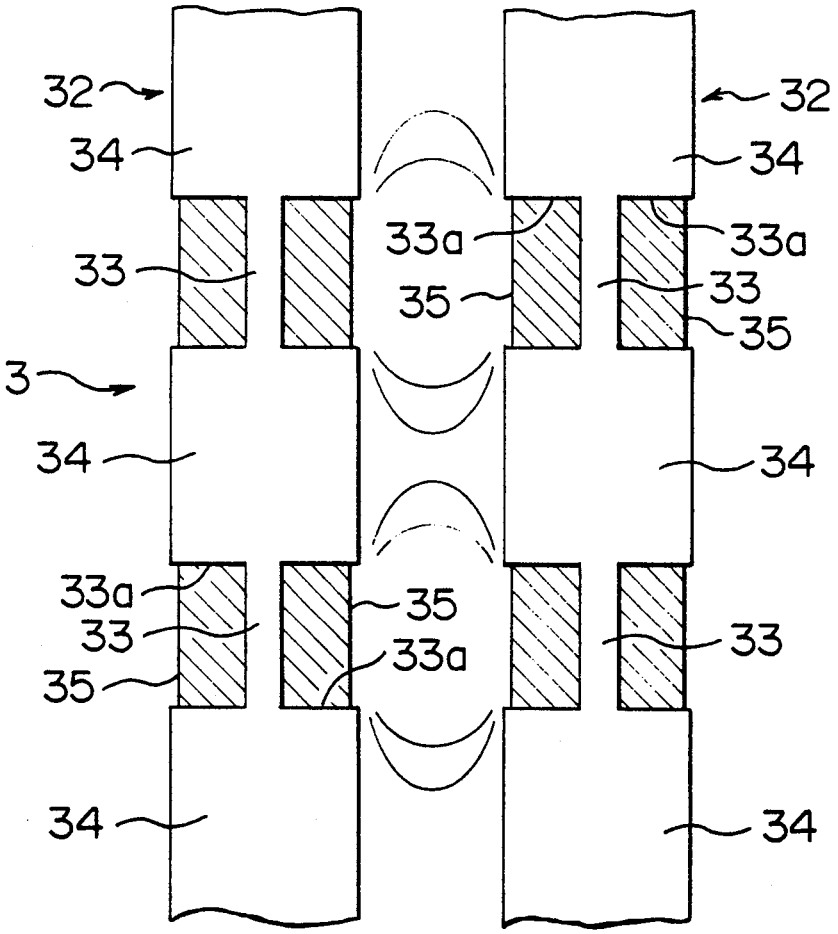
FIG. 5 is an enlarge plan view illustrating the modification shown in FIG. 4.

As shown in FIGS. 4 and 5, a high resistive material 35 is arranged in the recess 23 to enhance the electron beam travel. With this arrangement, the potential of the thin wall portion 33 is below that of the thick wall portion 34. A high voltage and a low voltage are alternately applied in the direction in which the electron beam travels. Hence, as shown in FIG. 5, it is possible for the electron beam, in which periodic electrostatic lenses are formed, to travel to substantially any desired positions. An advantage of this arrangement is to obtain efficient electrostatic lenses by forming a high voltage portion and a low voltage portion with a single application of voltage.

A voltage of 300V is applied to the side wall (conductive layer) 32 so that the voltage of the thin wall portion 33 is regulated to become 50–100V. For example, if an electron beam is at 100 eV, a current of 1–3 μA may be applied.

Figure 6:
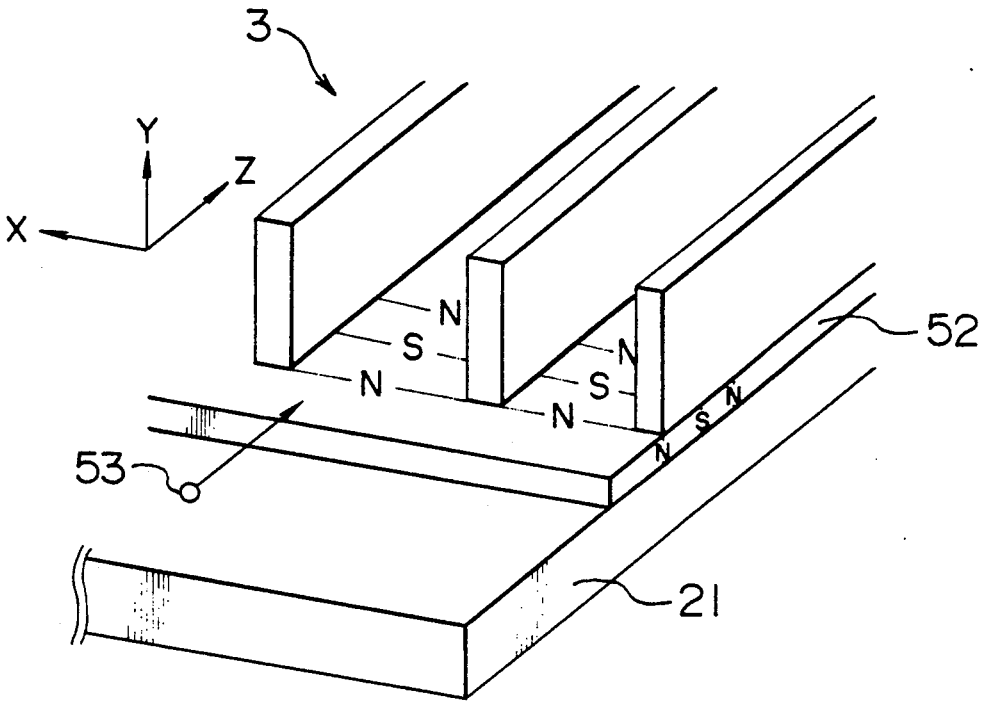
FIG. 6 is a perspective view showing a second modification to the electron beam guide.
Figure 7:
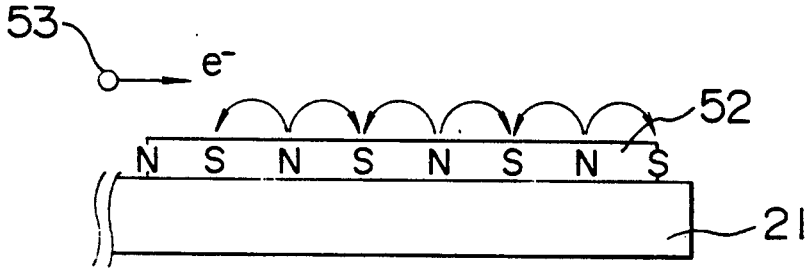
FIG. 7 is a schematic side view explaining an operation of the second modification to the electron beam guide.

FIG. 6 is a perspective view showing the electron beam guide 3 using a magnetostatic field and FIG. 7 is a cross-sectional view showing the electron beam guide 3 shown in FIG. 6.

Figure 8:
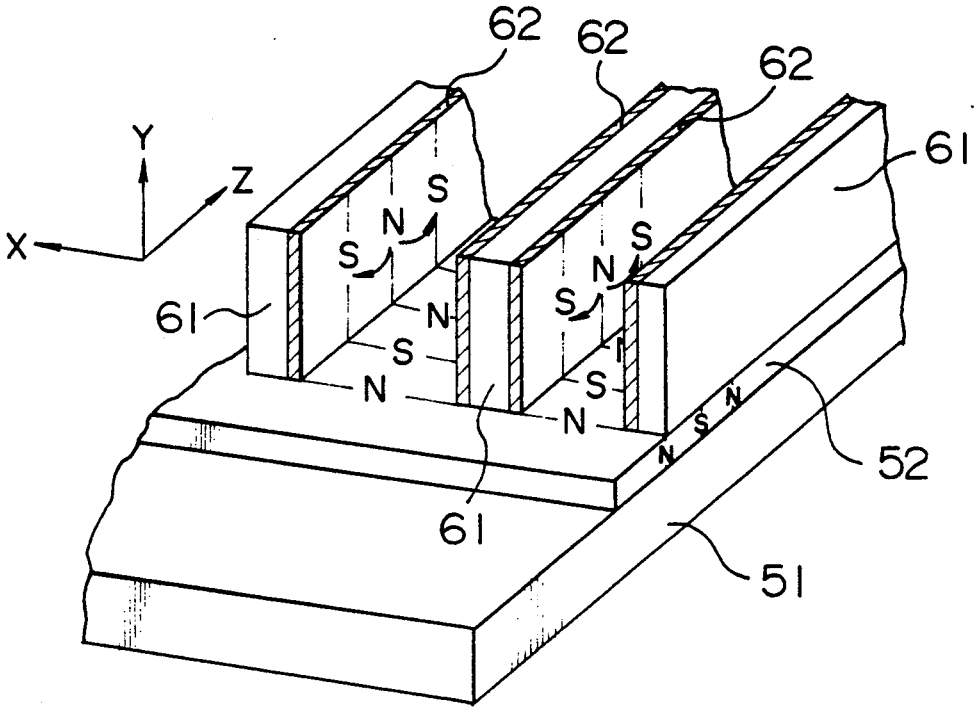
FIG. 8 is a perspective view illustrating a modification to the electron beam guide shown in FIG. 3.

A thin magnetic film 52 of a 0.01–100 μm thickness is formed on the glass substrate 21. The thin magnetic film 52 is made of a magnetic material, such as Gd-CO, Gd-Fe or $\gamma$-$Fe_2O_3$, and is magnetized at 1 to 10 mm pitches in the direction in which the electron beam travels. In the same manner as has just been described, a thin magnetic film is formed on a plane which opposes the glass substrate, for example, on the plane of the microchannel plate (not shown), and is magnetized. With this arrangement, the electron beam 53 travels to a desired position, while it is alternately converged and diverged under negative forces acting in the X direction. As shown in FIG. 8, to improve the effect of electron beam travel, a thin magnetic film 62 may be formed on the side face of a beam dividing wall 61 and be magnetized. The above-mentioned thin films 52, 62 can be formed by means of deposition, printing, or the like. As to magnetic materials for the magnetic films 52, 62, other magnetic recording materials may be utilized.

As another method of forming periodic magnetic lenses, a magnetic powder may be applied over at least a frit glass plate and then to be printed, calcined and magnetized by the screen printing as used for a plasma display or the like. The conditions required for selecting the magnetic powder are as follows:

1. 450° or more of Curie temperature
2. 600 Oe or more of magnetic coercive force The Curie temperature is determined by a thermal process during manufacture of the flat tube display apparatus according to the present invention. The magnetic coercive force should be set to a value such that the properties of the periodic magnetic lenses are not affected by electrical discharge or the like while the flat tube display apparatus in accordance with this invention is in operation.

As frit glass, magnetic powder such as barium ferrite or strontium ferrite are mixed with each other, together with a viscosity adjusting material and is then printed. According to an experiment, residual magnetization of 1000 Gauss was obtained while the above-mentioned conditions 1, 2 or the like were met. Magnetic materials such as cobalt, samarium, may be used to obtain much higher residual magnetization.

The electron beam transmission will now be described. Generally, if the size of a magnetic field is denoted as B and the potential of a beam radius r=b is denoted as Vb, the amount of a current I is obtained as follows:

$$I=A\times b^2\times B^2\times(Vb\text{-}CB^2\times b^2)^{0.5}$$

where, A is a constant

If a maximum value exists in the amount of a current I, $$I_{max}=16^2\times\pi\times\epsilon(e/m)^{0.5}\times Vb^{1.5}$$

According to this embodiment, an electron beam of about 1 μA was transmitted without being focused when the size of the magnetic field was 10 to 200 Gauss and the energy of the electron beam was at 100 eV.

Figure 9:
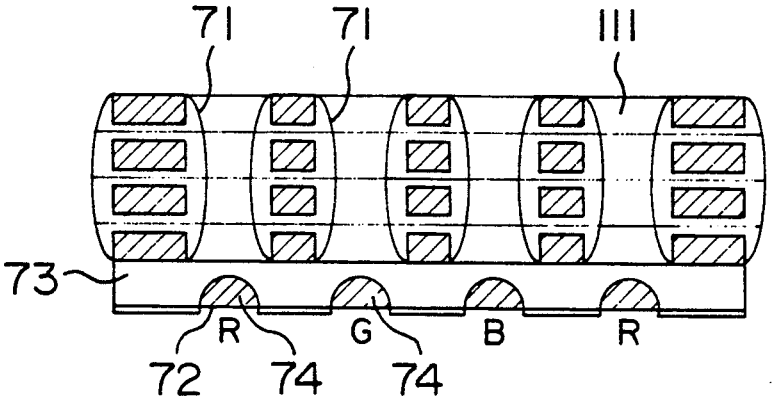
FIG. 9 is a view showing an electron beam amplifier and a display portion in the embodiment shown in FIG. 8.

FIG. 9 shows an electron beam amplifier and an emitting device. Pieces of frit glass 71 are coated on the entire thin metal plate 111 with a thickness of 0.2 mm. The thin metal plate 111 has substantially circular holes. The number of holes in a lengthwise direction is equal to three times as large as the trio number of the fluorescent substances and the number of holes in a widthwise direction is equal to the number of scanning lines. A transmission type electron multiplier 73 is laid under a high resistive material which is integrated by laminating three or four layers of the thin metal plate 111. The transmission type electron multiplier 73 has substantially circular opened holes whose shape is a substantially conical in cross section, and the number of holes is the same as in the above-mentioned high resistive material. An electron beam having been led by the electron beam guide 3 using the above-described electric field or magnetic field is deflected electrostatically or by using a magnetic field at a desired position and impinges upon the opened holes of the electron beam multiplier 73. The electron beam is multiplied while striking against the inner wall of the opened holes and enters into the transmission type electron multiplier 73 in the final stage. The electron beam then excites fluorescent substances 74 coated inside of the conical opened holes 72 and allows the fluorescent substance to emit light. A duck is applied to the surface coated with the fluorescent substance on the side of the transmission type electron beam amplifier 73.

According to this method, the so-called mislanding of an electron beam does not occur. Furthermore, it is possible to obtain excellent images which do not cause any change with time, any mislanding or any change in landing caused by a thermal expansion difference.

A microchannel plate, as will be explained hereinbelow, is utilized in this embodiment to improve the brightness of an image.

Figure 10:
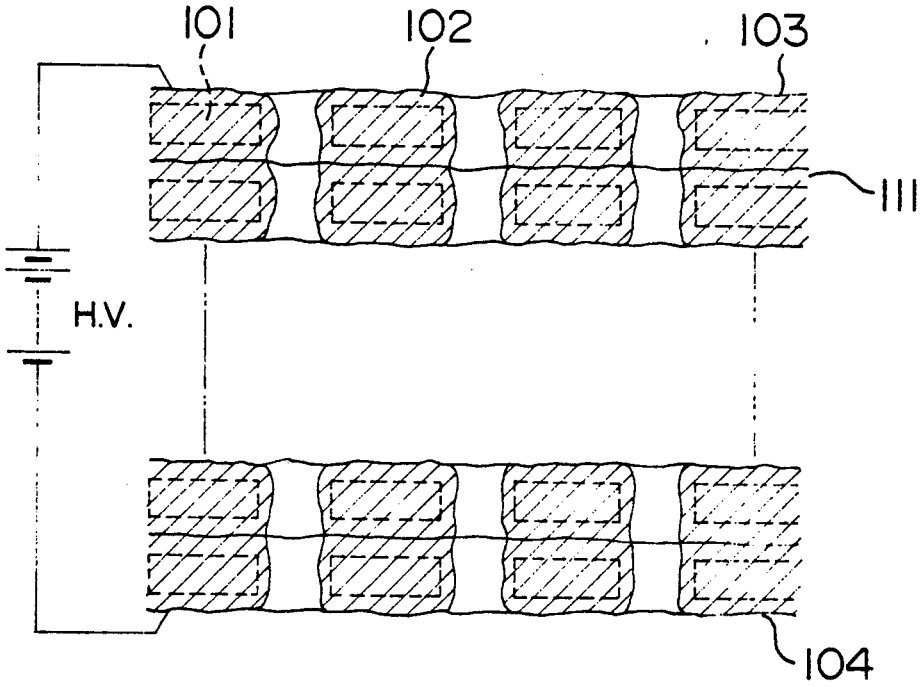
FIG. 10 is a cross-section view showing a microchannel plate in the embodiment shown in FIG. 9.
Figure 11A:
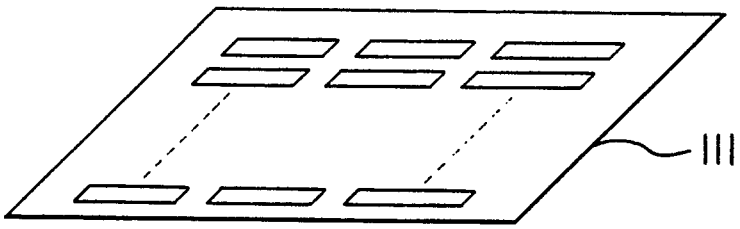
FIG. 11*a* is a view illustrating the shapes of the opened holes in the microchannel plate shown in FIG. 10.
Figure 11B:
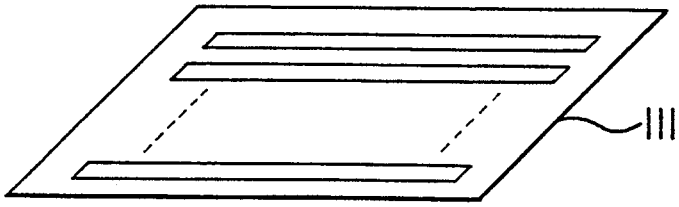
FIG. 11*b* is a view illustrating a modification to the shapes of the opened holes in the microchannel plate shown in FIG. 10.

An embodiment of the microchannel plate will now be described with reference to FIG. 10, which is an enlarged cross-sectional view of the microchannel plate. A number of substantially circular opened holes approximately 50–200 μm in diameter are arranged in the thin metal plate 111 with a thickness of 0.2 mm. The number of opened holes in a widthwise direction is equal to the number of fluorescent substances on the fluorescent face and the number of opened holes in a lengthwise direction is equal to the number of frame scanning lines. For example, substantially circular opened holes are provided at 0.6 mm of longitudinal pitches and 0.2 to 0.25 mm of horizontal pitches for 40-type high-vision television sets. Although it is desirable that the shape of the opened hole in cross section be linear, the shape of the opened hole does not appreciably affect the multiplication ratio of an electron beam because frit glass is applied to the opened holes from side to side of the electron beam multiplier 73 where the electron beam enters and goes out. Moreover, as shown in FIG. 11*a*, the shape of the opened hole may be rectangular extending transversely, the number of opened holes is equal to the trio number, or as shown in FIG. 2, the opened holes extend transversely only the ends of which being in contact with the external shape.

Frit glass (PbO) 102 with a thickness of 5 to 30 μm is applied to all the surfaces of the above-mentioned thin metal plate 111, that is, its inner and outer surfaces and the inner surfaces of the opened holes. Three or four layers of the thin metal plates 111 coated with the frit glass (PbO) are laminated to form a monolithic layer. The laminated thin metal plates 111 are reduced in a hydrogen atmosphere at 300° to 400° C. to form lead glass. The monolithic microchannel plate becomes a high resisting element of $10^8$–$10^{12}$ Ω and at the same time frit glass (PbO) on the inner surface of each opened hole becomes an electron beam multiplier, which provides a high electron beam multiplication ratio.

If the microchannel plate mold be deformed because of a change in the thermal expansion coefficient of the thin metal plate 111 and the frit glass during a thermal process, 42% Ni alloy, 6% Cr alloy or an INVAR material may be employed as a thin metal plate 111.

Further, in order to increase the multiplication ratio of electrons, a material providing a high secondary electron emission ratio, such as MgO or CsI, may be applied to the surface of the frit glass.

When a high voltage of 1 to 4 kV is applied at both ends 103, 104 of such an electron beam multiplier 73 (FIG. 10) as described above, a current of 10 to 1000 pA constantly flows, for example, in a 40-type high-vision television set. This solves problems with withstand voltage properties and the power consumption of such a current flow is negligible as compared with the total power consumption of the flat tube display apparatus.

Further, since the inner surfaces of the opened holes in the microchannel plate are substantially continuous without any gaps, electron beams are multiplied regardless of the incident angles thereof or the travel of the electron beams in the opened holes. Furthermore, before the frit glass 102 is applied to the thin metal plate 111, a strict precision is not required to position the opened holes disposed in the thin metal plate 111. This is because the frit glass 102 is applied after the positioning of the opened holes is finished.

In the two embodiments of the microchannel plate, the frit glass 102 used as a material for the microchannel plate has been described. The materials used for the microchannel plate will be hereinbelow described.

Figure 12A:
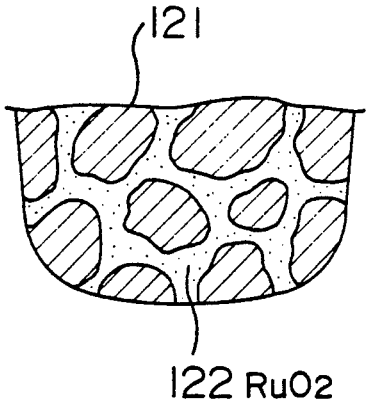
FIG. 12*a* is an enlarged view showing part of the forming process of a material used for multiplying the electrons according to an embodiment of the present invention.

FIG. 12*a* is a partially enlarged cross-sectional view showing part of a material used for the microchannel plate. The material is a mixture in which the frit glass 121 powder is mixed with $RuO_2$ 122 powder in a vehicle, or a mixture in which a small amount of admixture is mixed with the above-mentioned frit glass powder-$RuO_2$ powder mixture. The frit glass 121 powder and the $RuO_2$ 122 powder are mixed as shown in FIG. 12*a*. Since the mixture is pasty, it can easily form shape patterns required in the electron multiplying material by means of a printing technique. In addition, the manufacturing costs can be relatively saved by use of a printing process as compared with the conventional formation process.

Figure 12B:
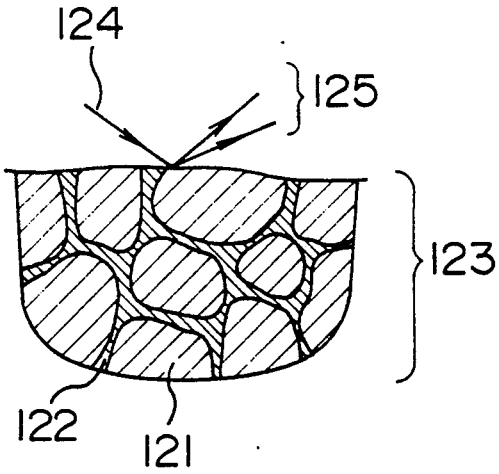
FIG. 12*b* is an enlarged view showing part of the material used for multiplying the electrons in the embodiment shown in FIG. 12*a;*
Figure 13:
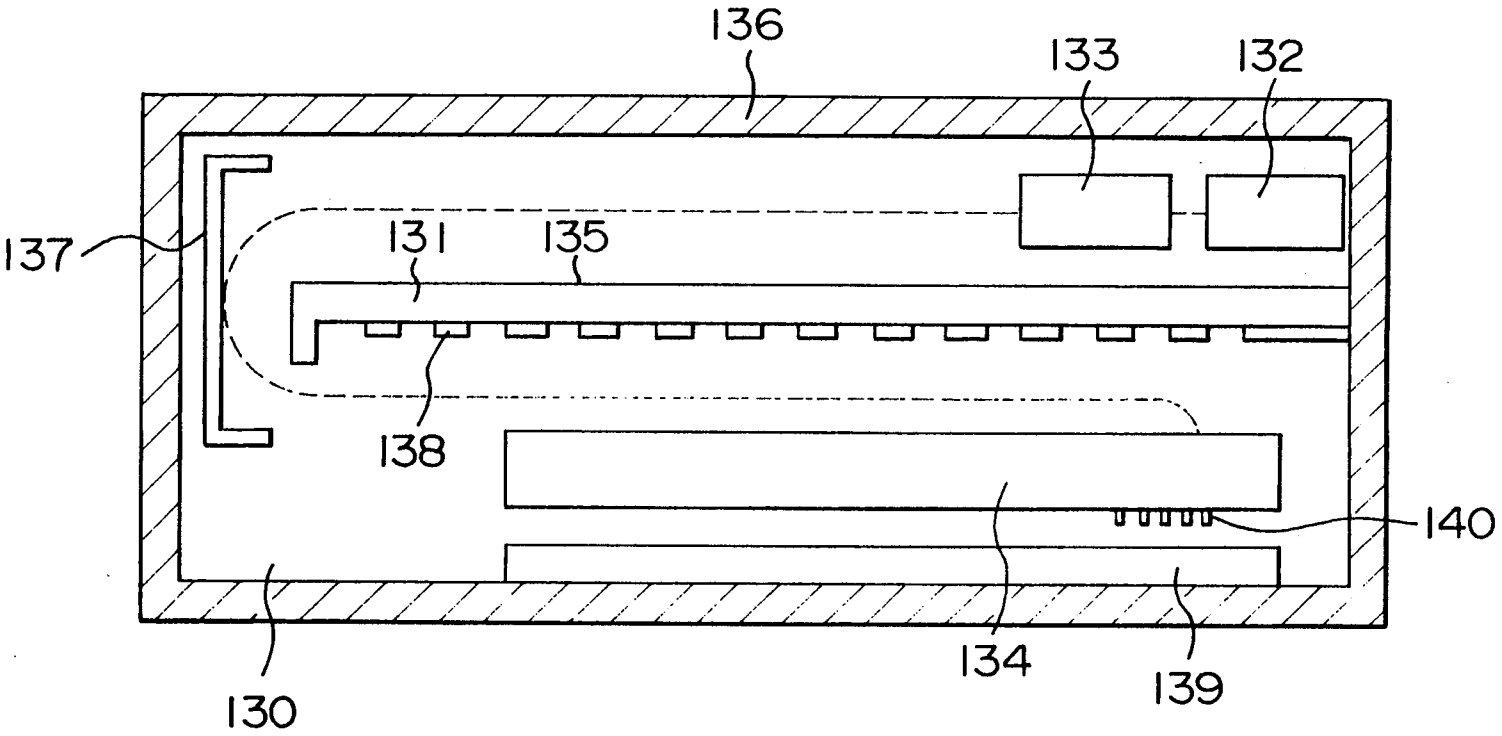
FIG. 13 PRIOR ART
FIG. 13 is a cross-sectional view showing the conventional flat tube display apparatus.
Figure 14A:
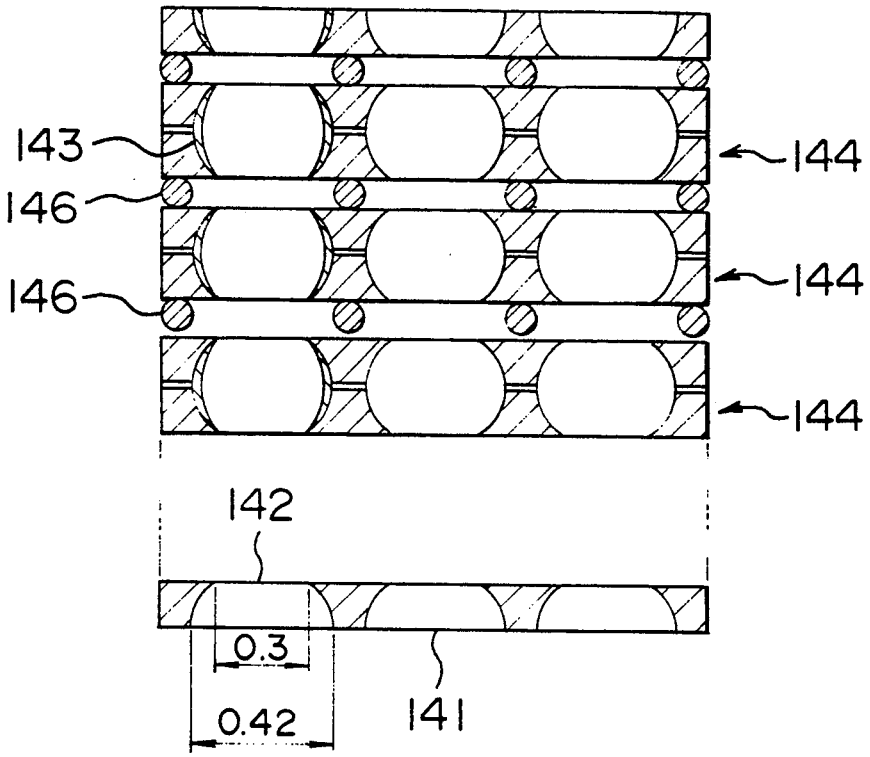
FIG. 14a PRIOR ART
FIGS. 14*a* and 14*b* are enlarged cross-sectional views illustrating the major components of the microchannel plate according to the conventional flat tube display apparatus.
Figure 14B:
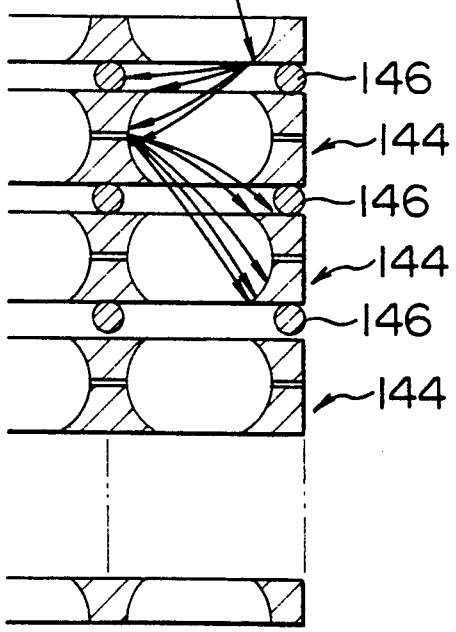
FIG. 14b PRIOR ART

FIG. 12*b* shows an electron multiplying material 123 which is calcined (sintered) in an air atmosphere at 400° to 500° C. The cross section of the electron multiplying material 123 is substantially formed as shown in FIG. 12*b*, although there are some differences in the cross section depending upon calcining conditions. As shown in FIG. 12*b*, the particles of $RuO_2$ 122 are linked together in a net-like manner so as to surround the particles of frit glass 121. Such a net-like construction can be quite easily obtained when frit glass 121 having a low melting point is calcined at a high temperature. The electric properties of the net-like structure conductive passageway determine the electric properties such as a resistivity of the electron multiplying material 123. Therefore, the resistivity of the electron multiplying material 123 can be controlled by changing the frit glass-$RuO_2$ mixing ratio and the calcining temperature.

In this embodiment, the average powder diameter of the frit glass 121 before being calcined is 0.1–10 μm and the average powder diameter of $RuO_2$ is 0.01–1 μm. It is a well-known from the research on thick film resistive substances used for hybrid ICs that the electric properties, such as the resistivity of the TCR, of the electron multiplying material 123 after being calcined can be controlled to some extent by selectively using proper inorganic oxides as an admixture. The secondary electron emission ratio $\delta$ of the electron multiplying material 123 after being calcined is substantially the same as that of glass in many cases; the ratio is between 2 and 4. Hence the electron multiplying material 123 using glass in this embodiment provides a relatively high secondary electron emission ratio and retains a suitable conductivity.

It is possible to provide a simple structure flat tube display apparatus which permits a high transmission ratio and solves problems with withstand voltage by employing magnetic periodic lenses as an electron beam guide. Furthermore, the electric properties of the electron multiplying material according to the present invention are stable, and the electron multiplying material is easily manufactured and processed. The electron multiplier using the electron multiplying material according to the present invention is stable in operation and allows a high electron multiplication ratio.

The invention has been described in detail with particular reference to the preferred embodiments thereof, but it will be understood that variations and modifications of the invention can be made within the spirit and scope of the invention.

What is claimed is:

1. A flat tube display apparatus comprising a vacuum tube body having housed therein (a) at least one electron source for emitting electron beams; (b) focussing means for focussing electron beams emitted from said electron source; (c) a fluorescent display screen onto which electron beams focussed by said focussing means land; and (d) parallel walls oriented substantially normal to said screen in a direction in which said electron beams travel and made of an insulating material or a highly resistive material, said parallel walls being disposed along substantially an entire length of said screen, a number of said walls being equal to a number of horizontal picture elements or three times the number of said horizontal picture elements on said screen, and said walls comprising an electron beam guide for applying to said electron beams a periodic magnetic field magnetized in substantially a same direction as a travel direction of said electron beams, wherein said electron beam guide is made of a mixture of at least frit glass and magnetic powder.

2. A flat tube display apparatus according to claim 1, wherein said magnetic powder includes at least barium ferrite or strontium ferrite.

3. A flat tube display apparatus comprising a vacuum tube body having housed therein (a) at least one electron source for emitting electron beams; (b) electron beam focusing means for focusing electron beams emitted from said electron source; (c) a florescent display screen having a plurality of horizontal picture elements and a florescent surface onto which said electron beams focused by said focusing means are adapted to land; (d) a plurality of side walls supporting said display screen and each having two side surfaces, said side walls extending across an entire length of said display screen in a travel direction of said electron beams and defining therebetween a plurality of paths which extend parallel to said florescent surface of said display screen and along which said electron beams travel, respectively, in parallel with said display screen; (e) guide means formed of magnetic films or a magnetic material disposed on said side surfaces of said side walls so as to extend along said paths, being periodically magnetized at intervals along said paths so as to guide said electron beams along said paths; and (f) means for deflecting said electron beams guided by said guide means at selected positions so as to direct said electron beams toward said display screen, wherein said electron beam guide means comprises at least frit glass and magnetic powder.

4. A flat tube display apparatus comprising a vacuum tube body having housed therein (a) at least one electron source for emitting electron beams; (b) electron beam focusing means for focusing electron beams emitted from said electron source; (c) a florescent display screen having a plurality of horizontal picture elements and a florescent surface onto which said electron beams focused by said focusing means are adapted to land; (d) a plurality of side walls supporting said display screen and each having two side surfaces, said side walls extending across an entire length of said display screen in a travel direction of said electron beams and defining therebetween a plurality of paths which extend parallel to said florescent surface of said display screen and along which said electron beams travel, respectively, in parallel with said display screen; (e) guide means formed of magnetic films or a magnetic material disposed on said side surfaces of said side walls so as to extend along said paths, being periodically magnetized at intervals along said paths so as to guide said electron beams along said paths; and (f) means for deflecting said electron beams guided by said guide means at selected positions so as to direct said electron beams toward said display screen, wherein said electron beam guide means comprises at least frit glass and magnetic powder, wherein said magnetic powder contains at least barium ferrite or strontium ferrite.

* * * * *